US012016443B2

(12) United States Patent
deGrood et al.

(10) Patent No.: US 12,016,443 B2
(45) Date of Patent: Jun. 25, 2024

(54) HAIR STYLER INCLUDING HINGED ARMS HAVING TWISTED HAIR CONTACT SURFACES

(71) Applicant: Spectrum Brands, Inc., Middleton, WI (US)

(72) Inventors: Michael John deGrood, Madison, WI (US); Jay William Kuzia, Madison, WI (US)

(73) Assignee: SPECTRUM BRANDS, INC., Middleton, WI (US)

( * ) Notice: Subject to any disclaimer, the term of this patent is extended or adjusted under 35 U.S.C. 154(b) by 425 days.

(21) Appl. No.: 17/419,208

(22) PCT Filed: Dec. 26, 2019

(86) PCT No.: PCT/US2019/068569

§ 371 (c)(1),
(2) Date: Jun. 28, 2021

(87) PCT Pub. No.: WO2020/139940

PCT Pub. Date: Jul. 2, 2020

(65) Prior Publication Data

US 2022/0110428 A1 Apr. 14, 2022

(30) Foreign Application Priority Data

Dec. 27, 2018 (CN) ..... 201811611231.0

(51) Int. Cl.
*A45D 1/04* (2006.01)
*A45D 1/12* (2006.01)
(Continued)

(52) U.S. Cl.
CPC ..... *A45D 1/04* (2013.01); *A45D 1/12* (2013.01); *A45D 2/001* (2013.01); *A45D 1/18* (2013.01); *A45D 2/002* (2013.01)

(58) Field of Classification Search
CPC ... A45D 1/02; A45D 1/04; A45D 1/06; A45D 1/08; A45D 1/10; A45D 1/12; A45D 1/14;
(Continued)

(56) References Cited

U.S. PATENT DOCUMENTS 6,070,596 A * 6/2000 Altamore ..... A45D 1/06 132/229
D901,770 S 11/2020 Wang
(Continued)

FOREIGN PATENT DOCUMENTS

CN 101564408 B1 10/2015
CN 206137462 U 5/2017
(Continued)

OTHER PUBLICATIONS

Extended European Search Report for EP Patent Application 19903646.8 dated Sep. 1, 2022; 9 pp.
(Continued)

*Primary Examiner* — Cris L. Rodriguez
*Assistant Examiner* — Karim Asqiriba
(74) *Attorney, Agent, or Firm* — Armstrong Teasdale LLP

(57) ABSTRACT

A hair styler generally comprises an upper arm, a lower arm, and a hinge. The upper arm includes an upper grip and an upper clamp head. The upper clamp head includes an upper hair contact surface. The upper hair contact surface is twisted relative to the upper grip. The lower arm includes a lower grip and a lower clamp head. The lower clamp head includes a lower hair contact surface. The lower hair contact surface is twisted relative to the lower grip. The hinge attaches the upper and lower arms together such that the upper and lower arms are openable and closeable relative to one another. The hair styler is configured to receive hair
(Continued)

between the upper and lower hair contact surfaces when the hair styler is in a closed position.

19 Claims, 14 Drawing Sheets

(51) Int. Cl.
*A45D 1/18* (2006.01)
*A45D 2/00* (2006.01)

(58) Field of Classification Search
CPC . A45D 1/18; A45D 1/28; A45D 2/001; A45D 2/002; A45D 2/40; A45D 2200/205
USPC ..... D28/35, 37
See application file for complete search history.

(56) References Cited

U.S. PATENT DOCUMENTS

| | | | | |
|---|---|---|---|---|
| 2004/0124188 | A1* | 7/2004 | Altamore | A45D 1/06 219/225 |
| 2005/0150511 | A1 | 7/2005 | Park | |
| 2010/0269848 | A1* | 10/2010 | Morgandi | A45D 1/04 132/269 |
| 2011/0061672 | A1* | 3/2011 | Schmider | A45D 1/12 132/226 |
| 2011/0061673 | A1 | 3/2011 | Yahnker et al. | |
| 2011/0220141 | A1* | 9/2011 | Chan | A45D 1/04 132/229 |
| 2014/0238432 | A1* | 8/2014 | Deng | A45D 1/04 132/229 |
| 2014/0261524 | A1* | 9/2014 | Smith | A45D 1/04 132/211 |
| 2015/0237983 | A1* | 8/2015 | Kock | A45D 2/001 132/229 |
| 2016/0213116 | A1 | 7/2016 | Williams | |
| 2016/0286928 | A1* | 10/2016 | Weatherly | A45D 2/40 |
| 2016/0360846 | A1 | 12/2016 | Shami | |
| 2022/0322802 | A1* | 10/2022 | Debenedictis | A45D 1/06 |

FOREIGN PATENT DOCUMENTS

| | | | |
|---|---|---|---|
| CN | 207023588 | U | 2/2018 |
| EP | 0077600 | A2 | 4/1983 |
| KR | 20100001162 | U | 2/2010 |
| KR | 101311808 | B1 | 9/2013 |

OTHER PUBLICATIONS

International Search Report and Written Opinion issued by the International Searching Authority regarding PCT/US2019/068569 mailed on Mar. 12, 2020; pp. 1-13.

* cited by examiner

HAIR STYLER INCLUDING HINGED ARMS HAVING TWISTED HAIR CONTACT SURFACES

CROSS-REFERENCE TO RELATED APPLICATION

This application is a 371 national stage of PCT Application No. PCT/US2019/068569 filed on Dec. 26, 2019 which claims the benefit of Chinese Patent Application No. 2018116112314.0 2019/068569 filed on Dec. 27, 2018, which are incorporated by reference herein in their entirety.

BACKGROUND

The present disclosure relates generally to a hair styler and, more particularly, to a hair styler including hinged arms and twisted hair contact surfaces.

Many conventional hair stylers have a pair of arms that are hingedly connected together to permit manual opening and closing of the arms relative to one another for straightening or curling hair between the arms. Each arm typically includes a clamp head and a hair contact surface on the clamp head. During use, hair is positioned between the hair contact surfaces and the hair is styled. The hair contact surfaces are generally flat and straight. Accordingly, a user may have difficulty in performing some styling operations with the hair stylers. In addition, the hair stylers may require the users to hold the hair stylers in awkward orientations when styling the hair and may not accommodate the users' preferred methods for gripping and manipulating the styler because of the orientations of the straight and flat hair contact surfaces relative to the handles.

There is a need, therefore, for a hair styler that can be used for a larger range of styling operations and that is more intuitive for a user to style their hair with as compared to at least some conventional hair straighteners.

SUMMARY

In one aspect, a hair styler generally comprises an upper arm, a lower arm, and a hinge. The upper arm includes an upper grip and an upper clamp head. The upper clamp head includes an upper hair contact surface. The upper hair contact surface is twisted relative to the upper grip. The lower arm includes a lower grip and a lower clamp head. The lower clamp head includes a lower hair contact surface. The lower hair contact surface is twisted relative to the lower grip. The hinge attaches the upper and lower arms together such that the upper and lower arms are openable and closeable relative to one another. The hair styler is configured to receive hair between the upper and lower hair contact surfaces when the hair styler is in a closed position.

In another aspect, a hair styler generally comprises a first arm including a first clamp plate and a second arm including a second clamp plate. The first and second clamp plates are twisted. The hair styler further includes a hinge attaching the first and second arms together such that the first and second arms are openable and closeable relative to one another. The hair styler is configured to receive hair between the first and second clamp plates when the hair styler is in a closed position. The hair styler also includes a heating system configured to deliver heat to the hair positioned between the first and second clamp plates.

In yet another aspect, a hair styler generally comprises a first clamp head including a first hair contact surface and a second clamp head including a second hair contact surface. The first and second hair contact surfaces are twisted. The hair styler also includes a handle attached to at least one of the first clamp head and the second clamp head, and a hinge attaching the first and second clamp heads together such that the first and second clamp heads are openable and closeable relative to one another. The hair styler is configured to receive hair between the first and second hair contact surfaces when the hair styler is in a closed position.

BRIEF DESCRIPTION

Corresponding reference characters indicate corresponding parts throughout the several views of the drawings.

DETAILED DESCRIPTION

As used herein, the terms "twist" or "twisted" refer to non-planar surfaces. For example, the non-planar surfaces may be curved or twisted relative to an axis.

Figure 1:
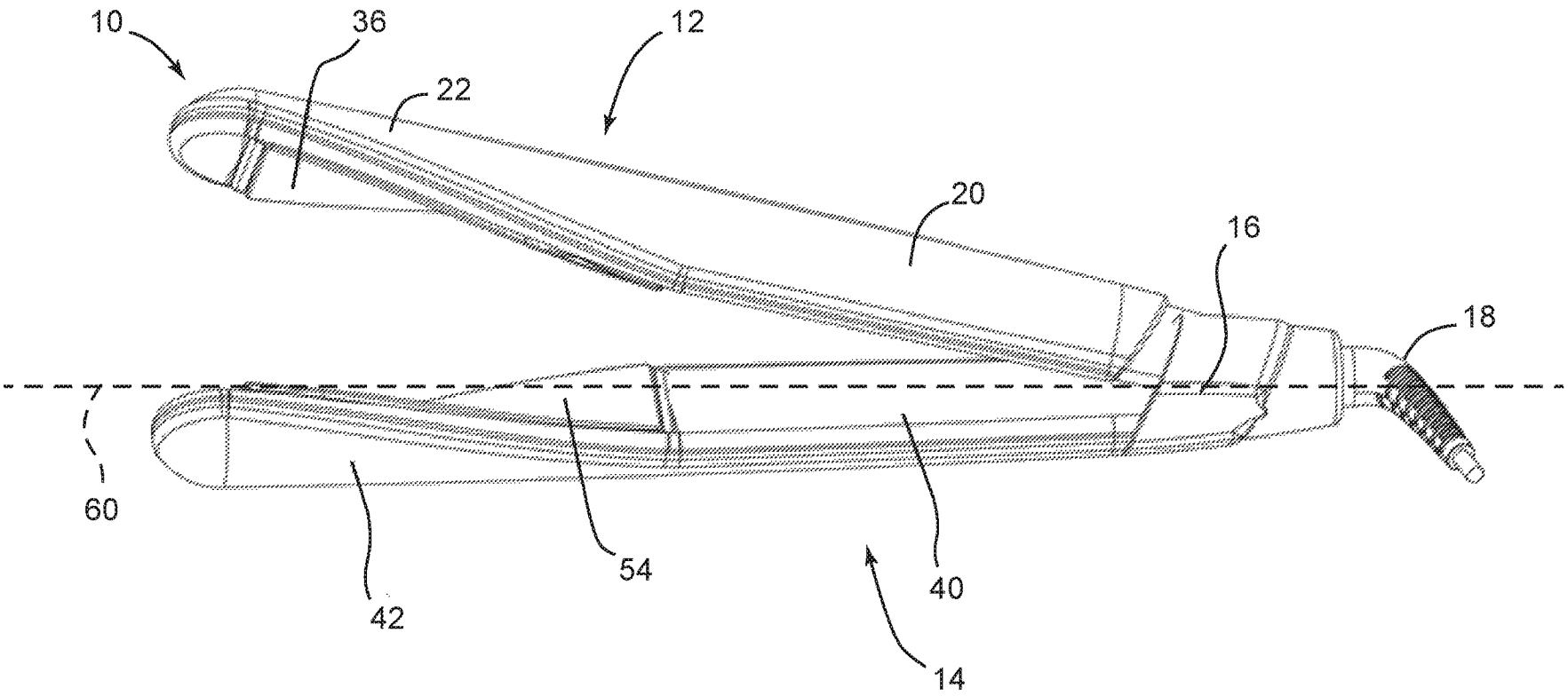
FIG. 1 is a perspective view of one suitable embodiment of a hair styler, the styler including upper and lower hinged arms having twisted (i.e., non-planar) hair contact surfaces, the hinged arms being in an opened position.
Figure 2:
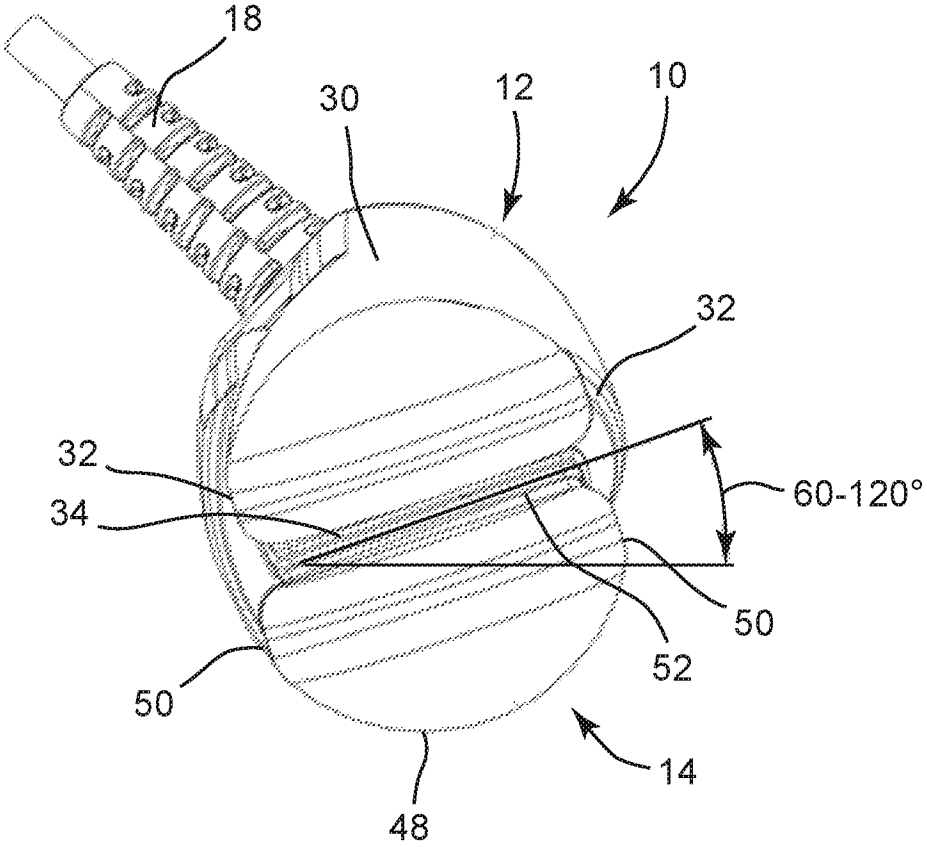
FIG. 2 is an end view of the hair styler of FIG. 1, with the hinged arms of the appliance in a closed position.
Figure 3:
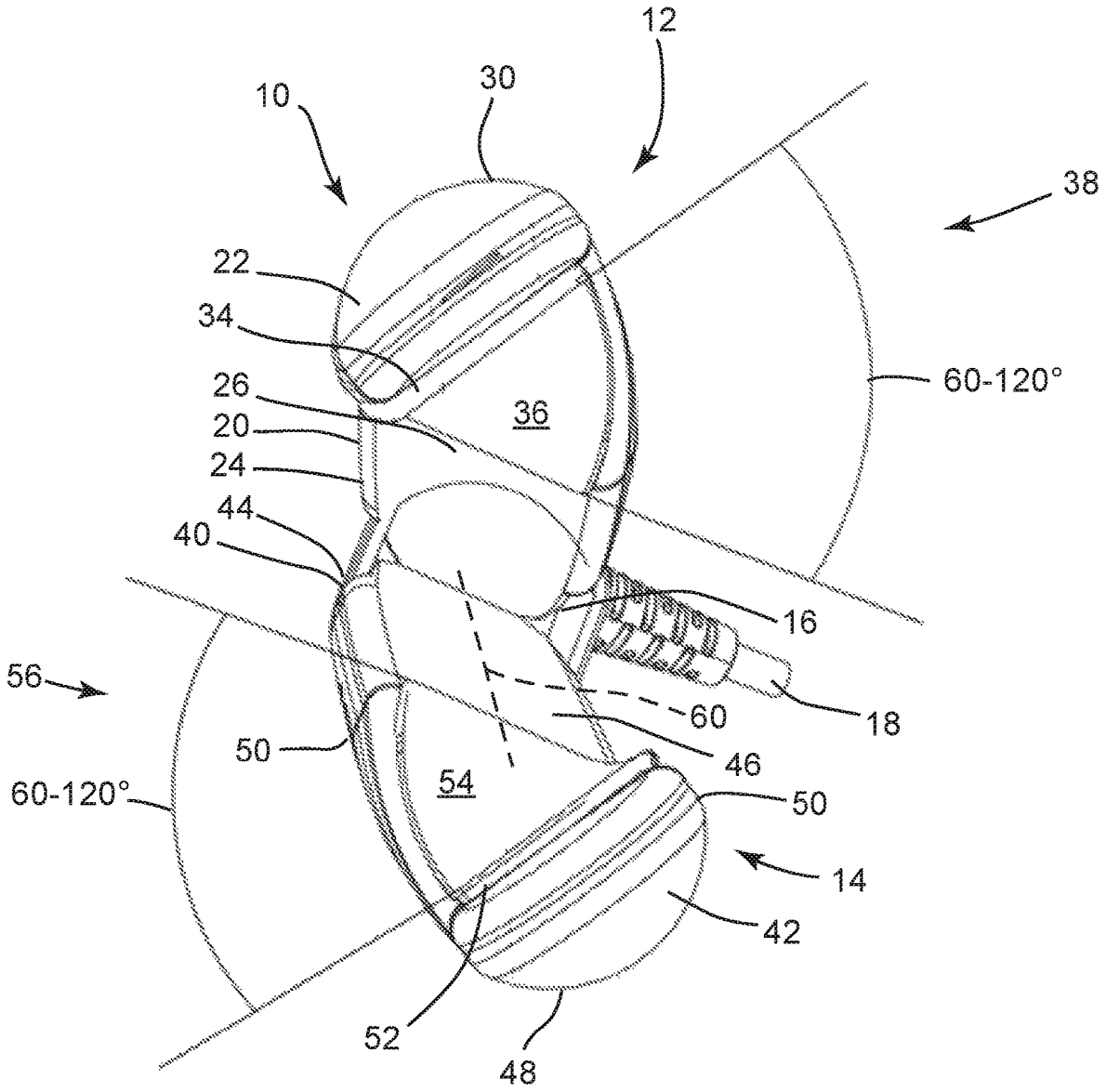
FIG. 3 is an end view of the hair styler of FIG. 1, with the hinged arms in the opened position.

Referring now to the drawings, and in particular to FIGS. 1-3, a hair styler of one suitable embodiment of the present disclosure is indicated generally by the reference numeral 10. The illustrated hair styler 10 comprises a pair of arms (namely, an upper or first arm indicated at 12 and a lower or second arm indicated at 14), a hinge 16 by which the arms 12, 14 are connected together, and a power cord 18 (partially illustrated in FIGS. 1-3). The hinge 16 is configured to facilitate opening and closing the arms 12, 14 relative to one another. The hair styler 10 has a longitudinal axis 60 extending through the hinge 16. The arms 12, 14 extend along the longitudinal axis 60 when the arms are in the closed position.

For operating the hair styler 10 in the manner set forth herein, the styler 10 may be provided with a power button (or "ON/OFF" switch), a temperature increase button (or "UP" switch), a temperature decrease button (or "DOWN" switch), and a graphical user interface (e.g., an LCD display). Suitably, in other embodiments, the hair styler 10 may be configured in any manner that facilitates user operation of the hair styler 10 as set forth herein (e.g., the hair styler 10 may have any suitable number of buttons and displays arranged in any suitable manner).

The upper arm 12 includes an upper grip 20 and an upper clamp head 22. The upper grip 20 includes an outer wall 24 and an inner plate 26 (FIG. 3). The upper clamp head 22 includes a top 30, two sides 32, and a clamp plate 34 opposite the top. The clamp plate 34 has an upper hair contact surface 36 that is twisted or non-planar. For example, the upper hair contact surface 36 extends between the sides 32 of the upper clamp head 22 at a first twist angle 38 relative to the inner plate 26 of the upper grip 20. The twist angle refers to the angular measurement of the curve or twist of a surface. In some suitable embodiments, the first twist angle 38 of the upper hair contact surface 36 may be in a range of about 60° to about 120°.

The lower arm 14 includes a lower grip 40 and a lower clamp head 42. The lower grip 20 includes an outer wall 44 and an inner plate 46 (FIG. 3). The lower clamp head 42 includes a bottom 48, two sides 50, and a clamp plate 52 opposite the bottom. The clamp plate 52 has a lower hair contact surface 54 that extends between the sides 50 of the lower clamp head 42 at a second twist angle 56 relative to the inner plate 46 of the lower grip 40. In some suitable embodiments, the second twist angle 56 of the upper hair contact surface 36 may be in a range of about 60° to about 120°.

The first twist angle 38 of the upper hair contact surface 36 and the second twist angle 56 of the lower clamp head 42 provide a twisted configuration of the hair styler 10 that enables the hair styler to be used for a range of styling operations including straightening or curling hair. Moreover, the twisted configuration of the hair styler 10 makes the hair styler more intuitive for a user to grasp and manipulate during a styling operation and provides a clear indication to the user that the hair styler 10 may be used to curl hair.

The hair styler 10 is positionable between a closed position (shown in FIG. 2) and an opened position (shown in FIGS. 1 and 3) by moving the upper arm 12 and the lower arm 14 relative to each other about the hinge 16. In the closed position, the upper arm 12 and the lower arm 14 are configured to receive and clamp hair between the upper hair contact surface 36 and the lower hair contact surface 54. Suitably, the first twist angle 38 is equal to the second twist angle 56 and the upper hair contact surface 36 and the lower hair contact surface 54 are configured to fit together and clamp the hair therebetween when the styler 10 is in the closed position.

In addition, the upper grip 20 and the lower grip 40 are sized and shaped to enable a user to grasp the hair styler 10 and position the arms 12, 14 in the opened and closed position. Accordingly, the upper grip 20 and the lower grip 40 at least partly form a handle for the user to grasp and manipulate the styler 10. Sometimes, the user may grasp the styler 10 using either the upper grip 20 or the lower grip 40. In other embodiments, a separate handle may be connected to the arms 12, 14.

In the illustrated embodiment, the outer wall 24 of the upper grip 20, the outer wall 44 of the lower grip 40, the top 30 of the upper clamp head 22, and the bottom 48 of the lower clamp head 42 are shaped such that the hair styler 10 is generally cylindrical when the styler is in the closed position. Also, the upper hair contact surface 36 and the lower hair contact surface 54 are twisted relative to the grips 20, 40. As a result, the user is able to comfortably grasp and manipulate the hair styler 10 and use the twisted portions of the arms 12, 14 to style hair.

As shown in FIGS. 1-3, the first twist angle 38 and the second twist angle 56 vary along the longitudinal axis 60 of the hair styler 10 to provide the twisted shape of the upper hair contact surface 36 and the lower hair contact surface 54. In other words, the upper hair contact surface 36 and the lower hair contact surface 54 are nonplanar and are curved along the longitudinal axis 60 of the styler 10 and perpendicular to the longitudinal axis. In contrast and as best seen in FIG. 1, the inner plate 26 of the upper grip 20 and the inner plate 46 of the lower grip 20 are generally planar and extend parallel to the longitudinal axis 60 of the styler 10 when the hair styler is in the closed position. Accordingly, the styler 10 is twisted along the portion of the arms 12, 14 that contact the hair and is not twisted along the portion of the arms 12, 14 that is grasped by the user.

In some suitable embodiments, the hair styler 10 is configured to deliver heat to hair positioned between the arms 12, 14 for the styling operation. For example, the upper hair contact surface 36 and/or the lower hair contact surface 54 may be heating surfaces of heat generating plates connected to electric control devices. Accordingly, the hair styler 10 is configured to deliver heat to the hair through the twisted hair contact surfaces 36, 54.

During operation, a user opens the hair styler 10 and positions hair between the arms 12, 14. The hair extends across and contacts the hair contact surfaces 36, 54. Heat may be delivered to the hair through at least one of the hair contact surfaces 36, 54. The user can then move the styler 10 along the hair to perform a styling operation such as curling or straightening the hair. The twisted shape of the styler 10 allows the user to perform a range of styling operations and grasp the styler comfortably. When the styling operation for the hair has been completed, the user opens the styler 10 and removes the hair. The user may then position another section of hair between the arms 12, 14 and clamp the styler 10 onto the hair.

Figure 4:
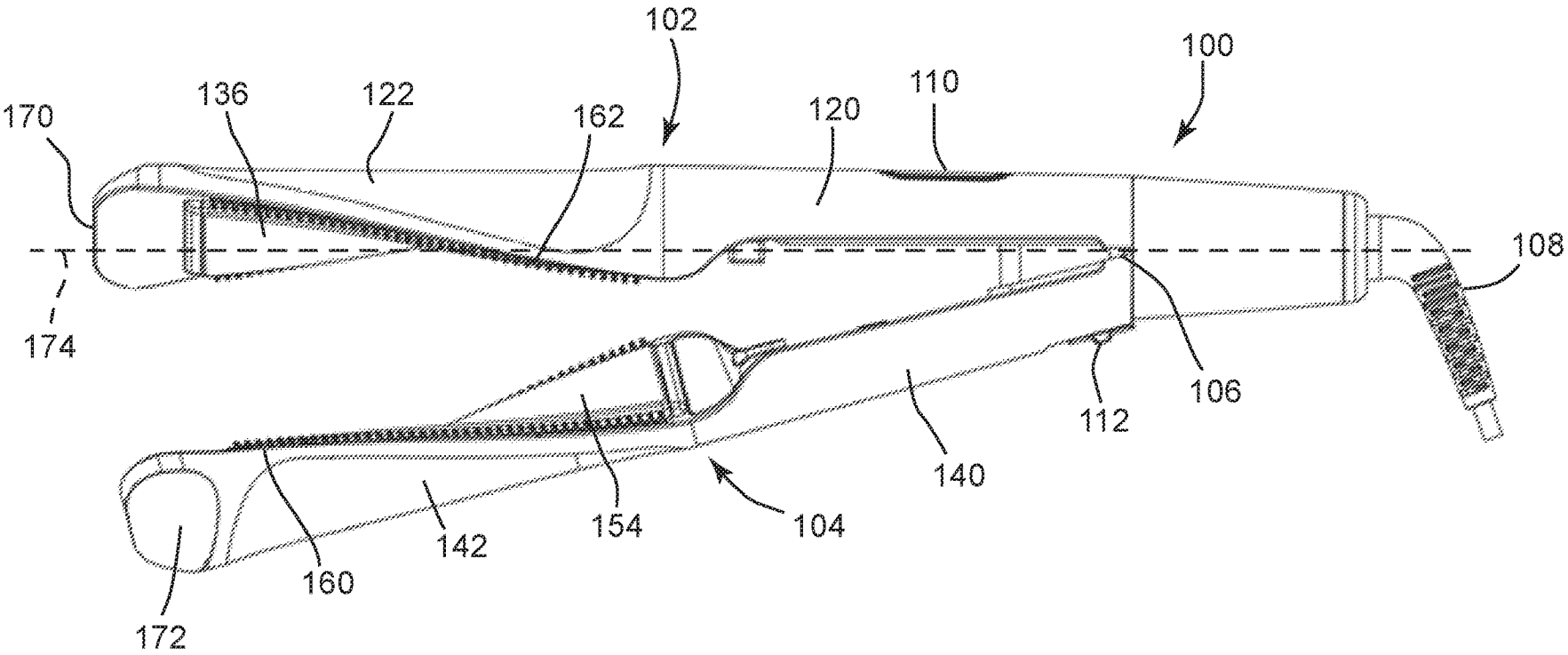
FIG. 4 is a side view of another suitable embodiment of a hair styler in an opened position, the hair styler including hinged upper and lower arms having twisted hair contact surfaces and teeth along edges of the surfaces.
Figure 5:
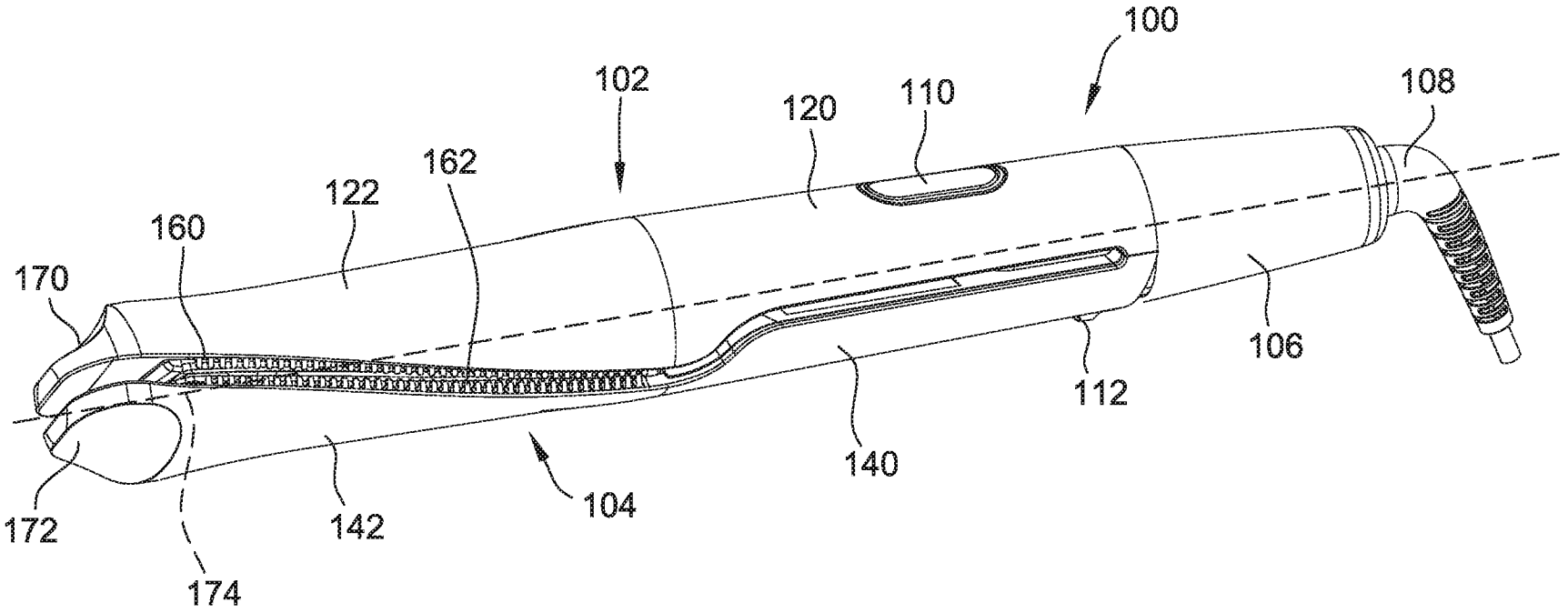
FIG. 5 is a side view of the hair styler of FIG. 4 in a closed position.

Referring to FIGS. 4 and 5, a hair styler of another suitable embodiment of the present disclosure is generally indicated by the reference number 100. The illustrated hair styler 100 comprises a pair of arms (namely, an upper or first arm indicated at 102 and a lower or second arm indicated at 104), a hinge 106 by which the arms 102, 104 are connected together, and a power cord 108 (partially illustrated in FIGS. 4 and 5). The hinge 106 is configured to facilitate opening and closing the arms 102, 104 relative to one another. The arm 104 is provided with a user interface 110 such as a touch screen including a power button (or "ON/OFF" switch), a temperature increase button (or "UP" switch), a temperature decrease button (or "DOWN" switch), and a graphical user interface (e.g., an LCD display). In addition, the arm 102 may include a lock 112 to lock the styler 100 in the opened or closed position. Suitably, in other embodiments, the hair styler 100 may be configured in any manner that facilitates user operation of the hair styler 100 as set forth herein (e.g., the hair styler 100 may have any suitable number of buttons and displays arranged in any suitable manner).

Figure 7:
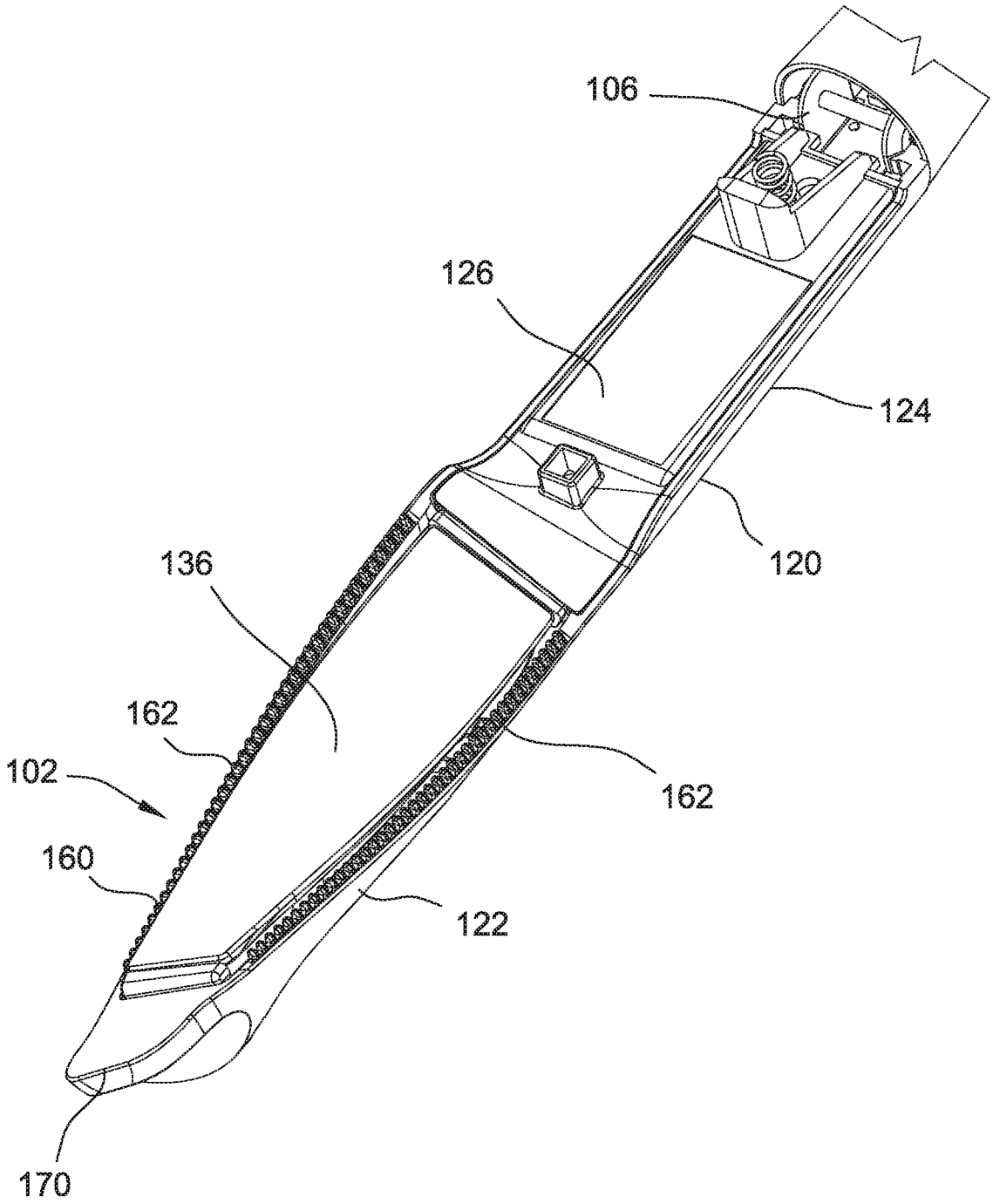
FIG. 7 is a perspective view of a portion of the hair styler of FIG. 4 with the lower arm removed to illustrate the twisted hair contact surface of the upper arm of the styler.

The upper arm 102 includes an upper grip 120 and an upper clamp head 122. The upper grip 120 includes an outer wall 124 and an inner plate 126 (FIG. 7). The upper clamp head 122 includes a top 130, two sides 132, and an upper clamp plate 134. The upper clamp plate 134 has an upper hair contact surface 136 that extends between the sides 132 of the upper clamp head 122 at a first twist angle 138 relative to the inner plate 126 of the upper grip 120.

Figure 6:
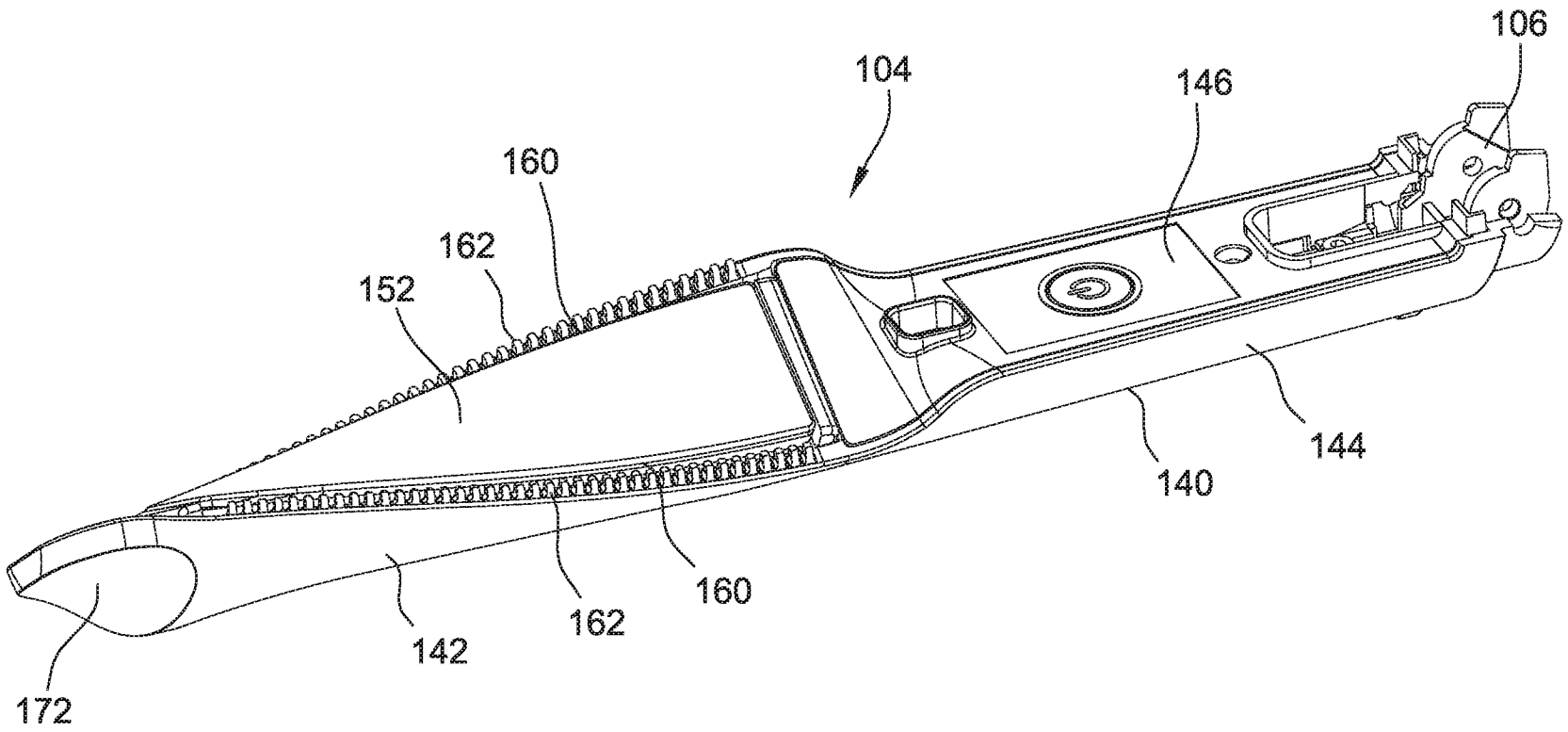
FIG. 6 is a perspective view of a portion of the hair styler of FIG. 4 with the upper arm removed to illustrate the twisted hair contact surface of the lower arm of the styler.

The lower arm 104 includes a lower grip 140 and a lower clamp head 142. The lower grip 140 includes an outer wall 144 and an inner plate 146 (FIG. 6). The lower clamp head 142 includes a bottom 148, two sides 150, and a lower clamp plate 152. The lower clamp plate 152 has a lower hair contact surface 154 that extends between the sides 150 of the lower clamp head 142 at a second twist angle 156 relative to the inner plate 146 of the lower grip 140.

Moreover, as seen in FIGS. 6-10, the first twist angle 138 and the second twist angle 156 vary along a longitudinal axis 174 of the hair styler 100. For example, the first twist angle 138 and the second twist angle 156 are different at the longitudinal position shown in FIG. 9 and the longitudinal position shown in FIG. 10. Accordingly, the upper hair contact surface 136 and the lower hair contact surface 154 are twisted about the longitudinal axis 174 and curve in multiple directions.

Figure 8:
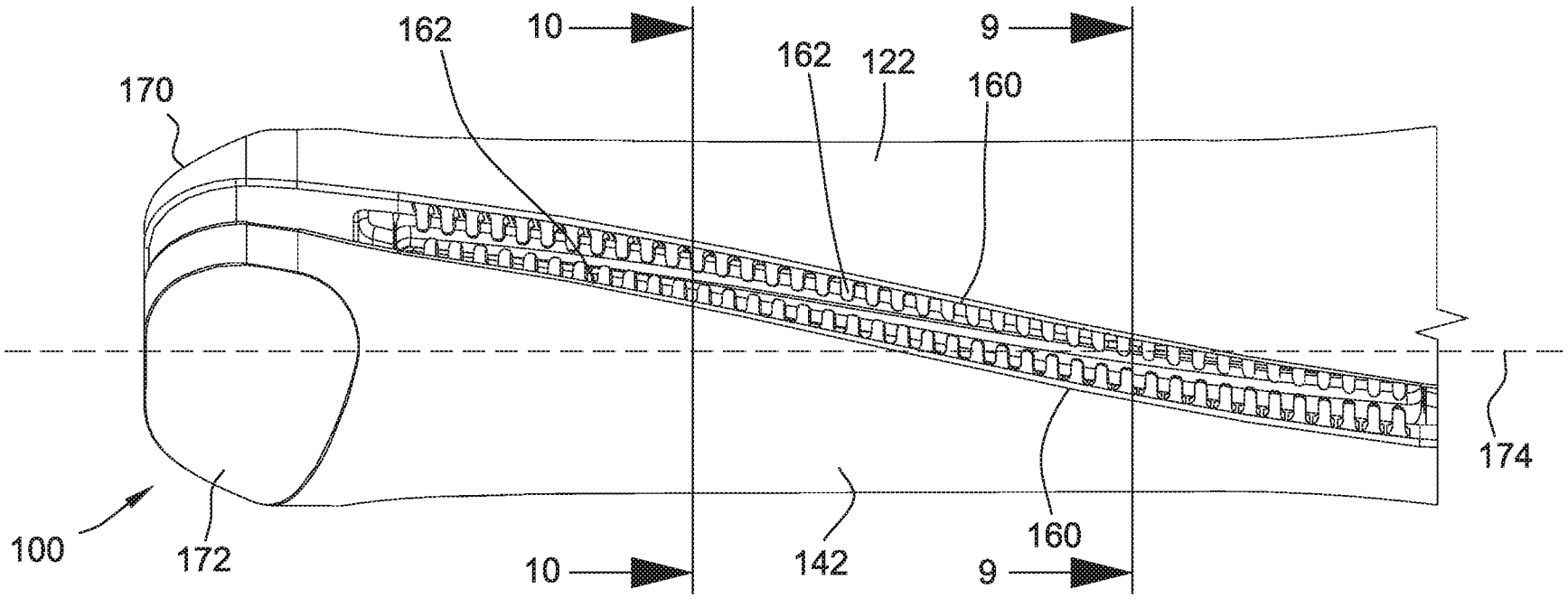
FIG. 8 is an enlarged perspective view of a portion of the hair styler as seen in FIG. 5 illustrating the teeth along the twisted hair contact surfaces of the hinged arms of the hair styler.

Referring to FIGS. 6-8, the hair styler 100 also includes teeth 162 extending along edges 160 of the upper hair contact surface 136 and the lower hair contact surface 154. In the illustrated embodiment, the teeth 162 extend downward from the sides 132 of the upper clamp head 122 and upward from the sides 150 of the lower clamp head 142 and the teeth 162 are configured to engage each other when the hair styler 100 is in the closed position. In addition, the teeth 162 may engage hair positioned between the arms 102, 104 during the hair styling operation and may comb the hair as the hair styler 100 is moved along the hair. In the illustrated embodiment, the upper clamp head 122 and the lower clamp head 142 each include a single row of teeth 162. In other embodiments, the upper clamp head 122 and/or the lower clamp head 142 may include two or more rows of teeth 162.

The hair styler 100 includes an upper end grip 170 attached to the upper clamp head 122 and a lower end grip 172 attached to the lower clamp head 142. The upper end grip 170 and the lower end grip 172 are on ends of the upper arm 102 and the lower arm 104, respectively, opposite the upper grip 120 and the lower grip 140. Accordingly, the user is able to grip the ends of the clamp heads 122, 142 during a hair styling operation. Gripping the upper and lower end grips 172 allow a user to clamp the styler 100 tighter on the hair and guide the styler along the hair during the hair styling operation.

Figure 9:
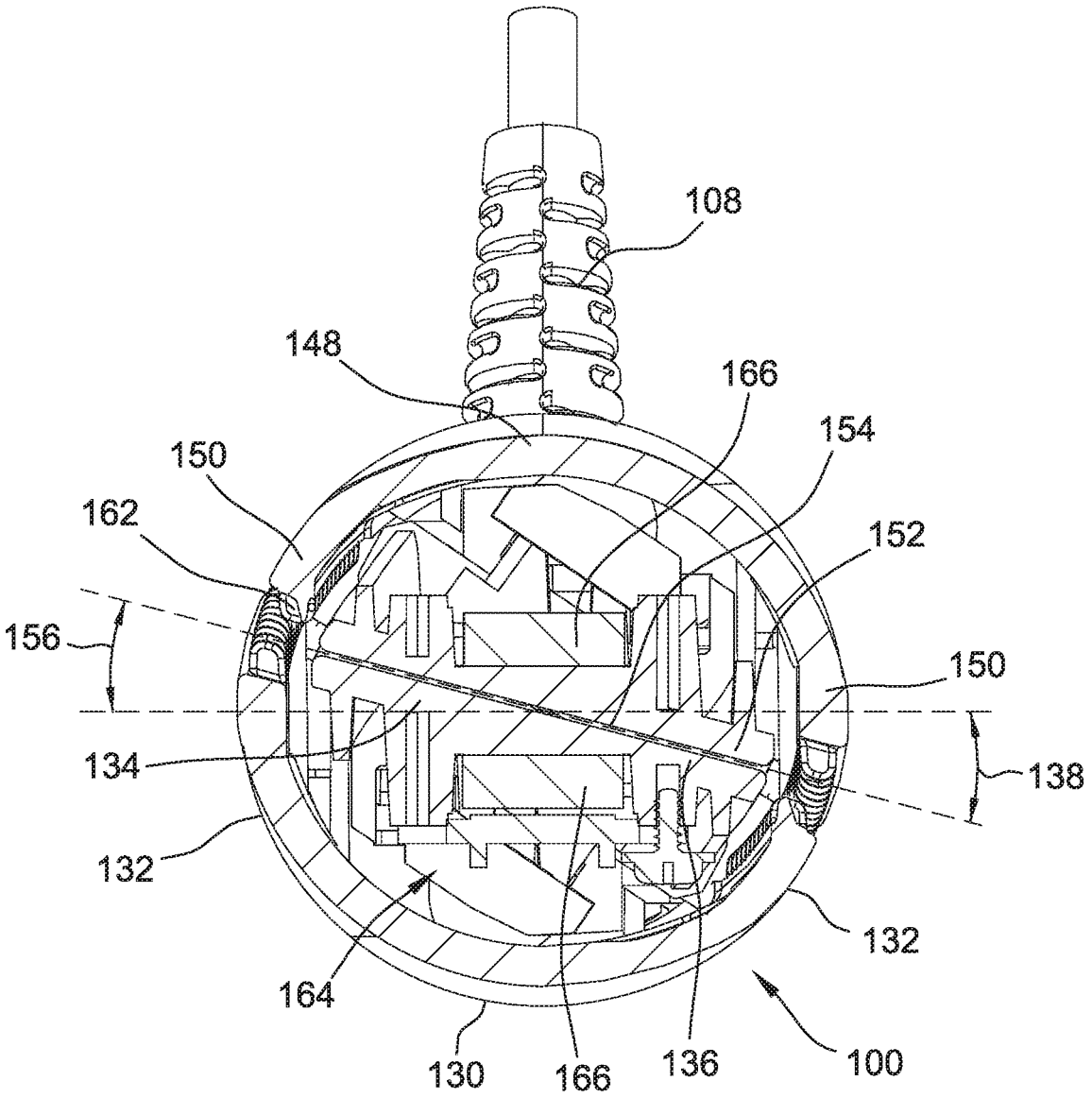
FIG. 9 is a cross-sectional view of the hair styler taken along section line 9-9 shown in FIG. 8.
Figure 10:
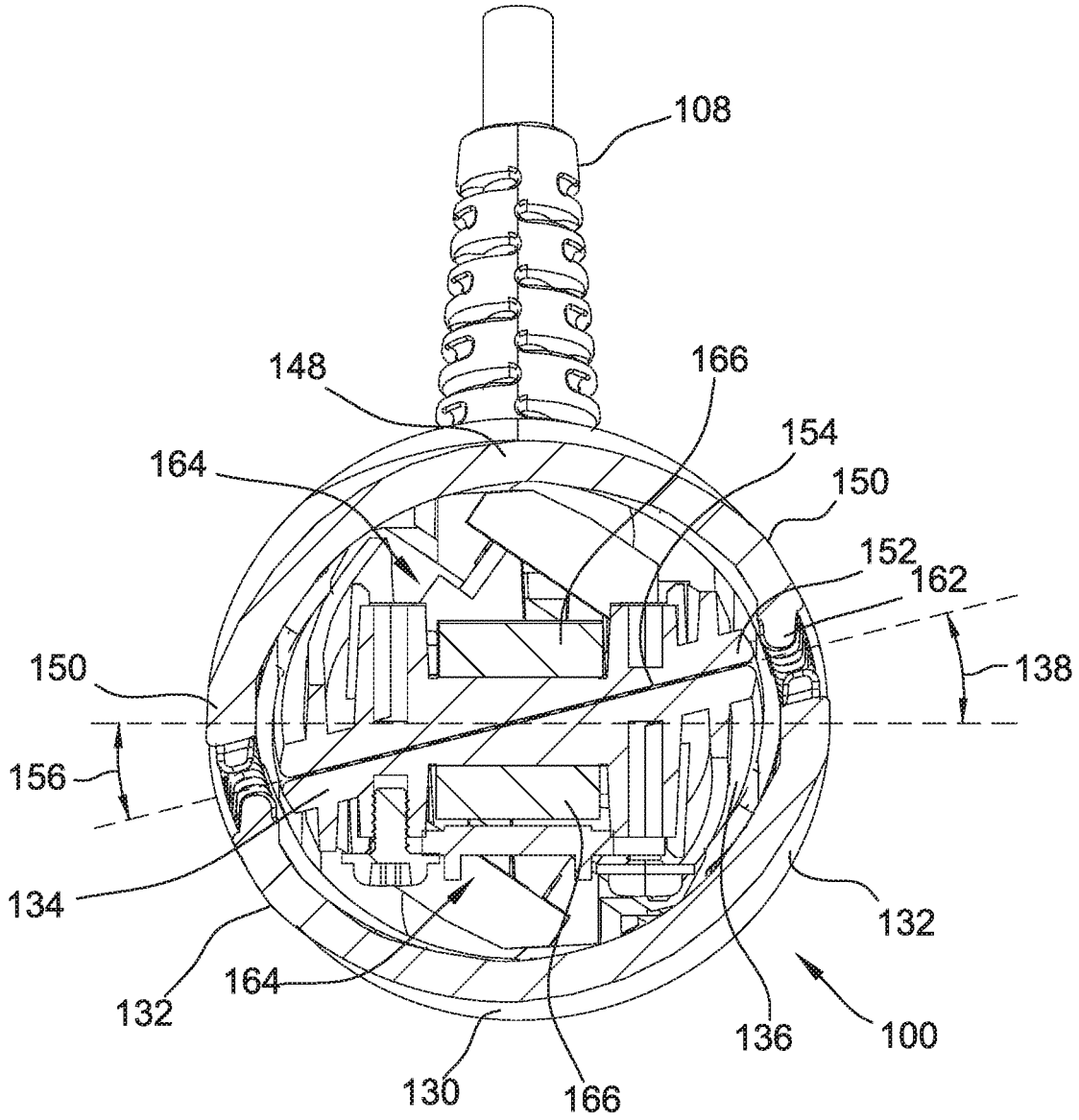
FIG. 10 is a cross-sectional view of the hair styler taken along section line 10-10 shown in FIG. 8.
Figure 11:
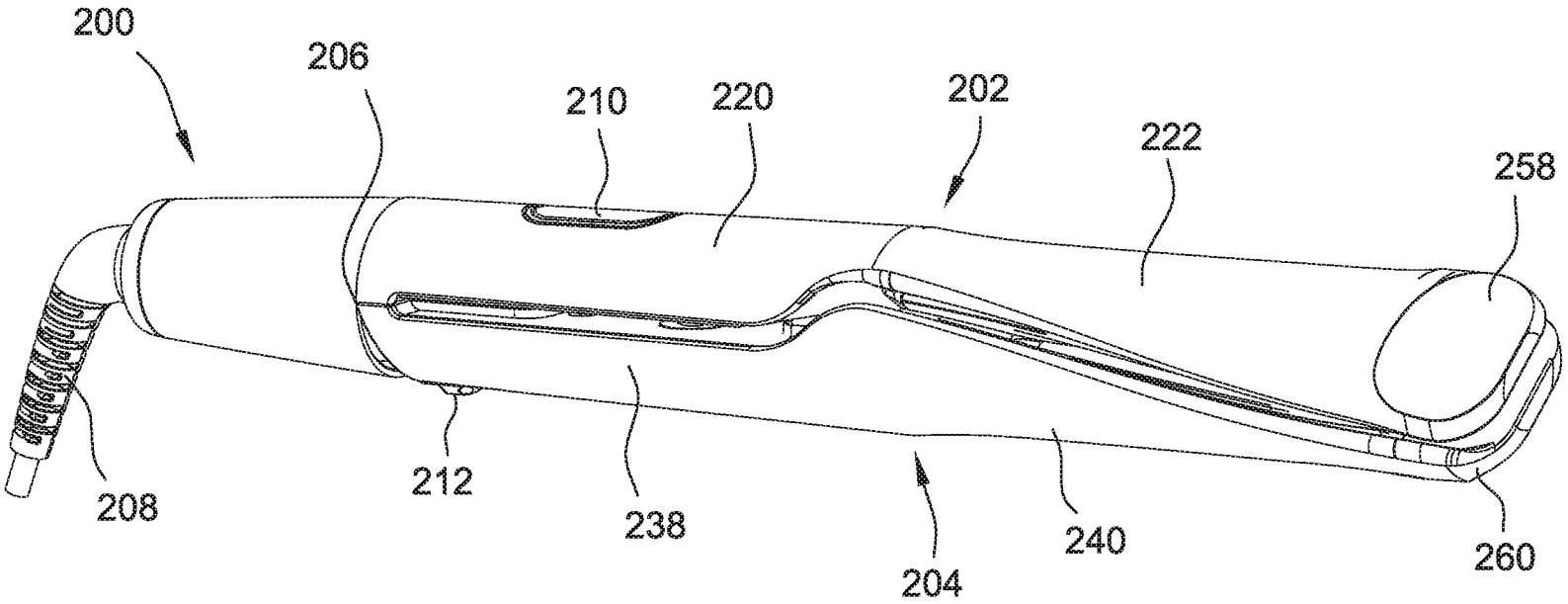
FIG. 11 is a perspective view of yet another embodiment of a hair styler in a closed position, the hair styler including hinged upper and lower arms having twisted hair contact surfaces and upper and lower grips on opposite ends of the arms.
Figure 12:
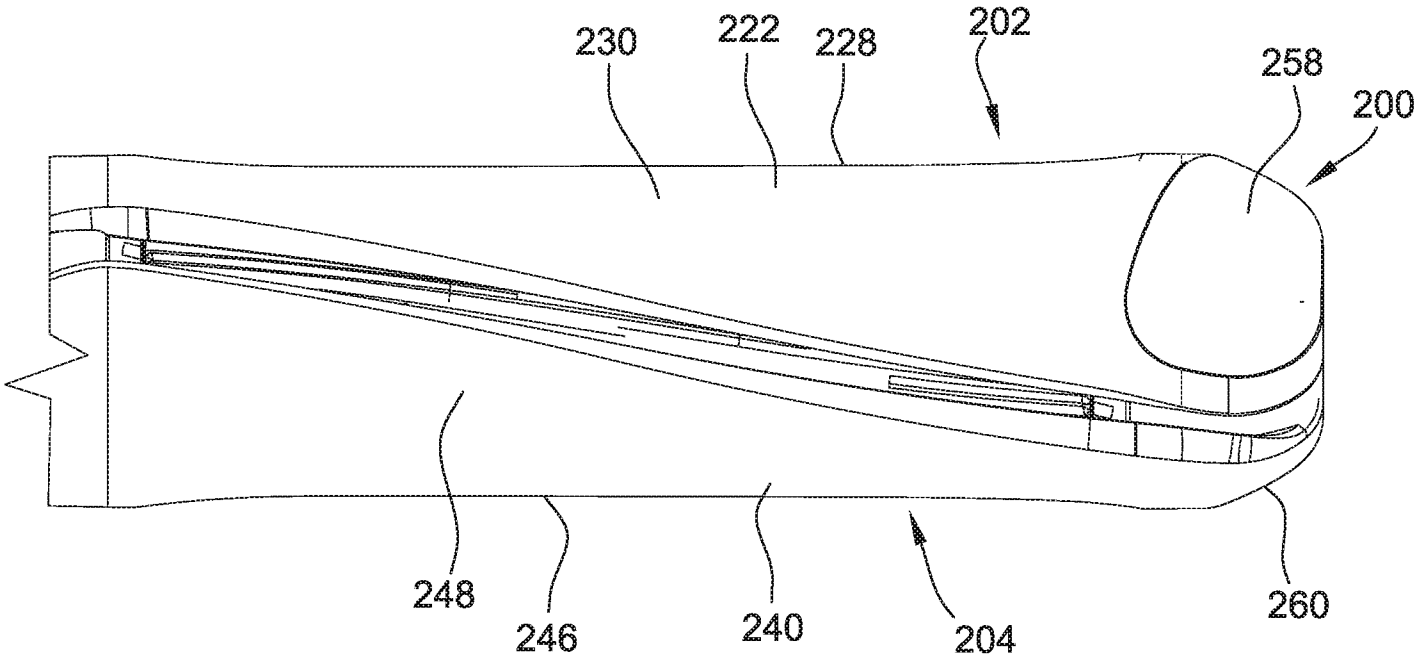
FIG. 12 is an enlarged perspective view of a portion of the hair styler of FIG. 11.

Referring to FIGS. 9 and 10, the hair styler 100 includes at least one heating assembly 164 enclosed within the upper clamp head 122 and the lower clamp head 142. The heating assembly 164 is configured to deliver heat to hair throughout the upper and lower hair contact surfaces 136, 154. For example, the heating assembly 164 includes heating elements 166 connected to the clamp plates 134, 152 and to electric control devices for regulating the temperature of the heating assembly. The upper and lower hair contact surfaces 136, 154 may be heating surfaces of the clamp plates 134, 152 and be configured to deliver heat to the hair. For example, in the illustrated embodiment, the heating elements 166 extend along the longitudinal axis and are mounted to the clamp plates 134, 152 at an angle relative to the upper and lower hair contact surfaces 136, 154. Accordingly, the heating elements 166 are not twisted like the upper and lower hair contact surfaces 136, 154 and are able to have a standardized shape. In other embodiments, the hair styler 100 may include any suitable heating assembly.

In some embodiments, the hair styler 100 may include a first insulation layer positioned between the upper hair contact surface 136 and the top 130 and a second insulation layer positioned between the lower hair contact surface 154 and the bottom 148. The insulation layers may allow the upper and lower clamp heads 122, 142 to maintain a lower temperature than the hair contact surfaces 136, 154 when the hair contact surfaces are heated. The insulation layers may include a cold gel, heat insulation foam, and/or any other suitable insulation material.

Referring to FIGS. 11-14, a hair styler of yet another suitable embodiment of the present disclosure is generally indicated by the reference number 200. The illustrated hair styler 200 comprises a pair of arms (namely, an upper or first arm indicated at 202 and a lower or second arm indicated at 204), a hinge 206 by which the arms 202, 204 are connected together, and a power cord 208 (partially illustrated in FIGS. 11 and 14). The hinge 206 is configured to facilitate opening and closing the arms 202, 204 relative to one another. The arm 204 is provided with a user interface 210 such as a touch screen including a power button (or "ON/OFF" switch), a temperature increase button (or "UP" switch), a temperature decrease button (or "DOWN" switch), and a graphical user interface (e.g., an LCD display). In addition, the arm 202 may include a lock 212 to lock the styler 200 in the opened or closed position. Suitably, in other embodiments, the hair styler 200 may be configured in any manner that facilitates user operation of the hair styler 200 as set forth herein (e.g., the hair styler 200 may have any suitable number of buttons and displays arranged in any suitable manner).

Figure 14:
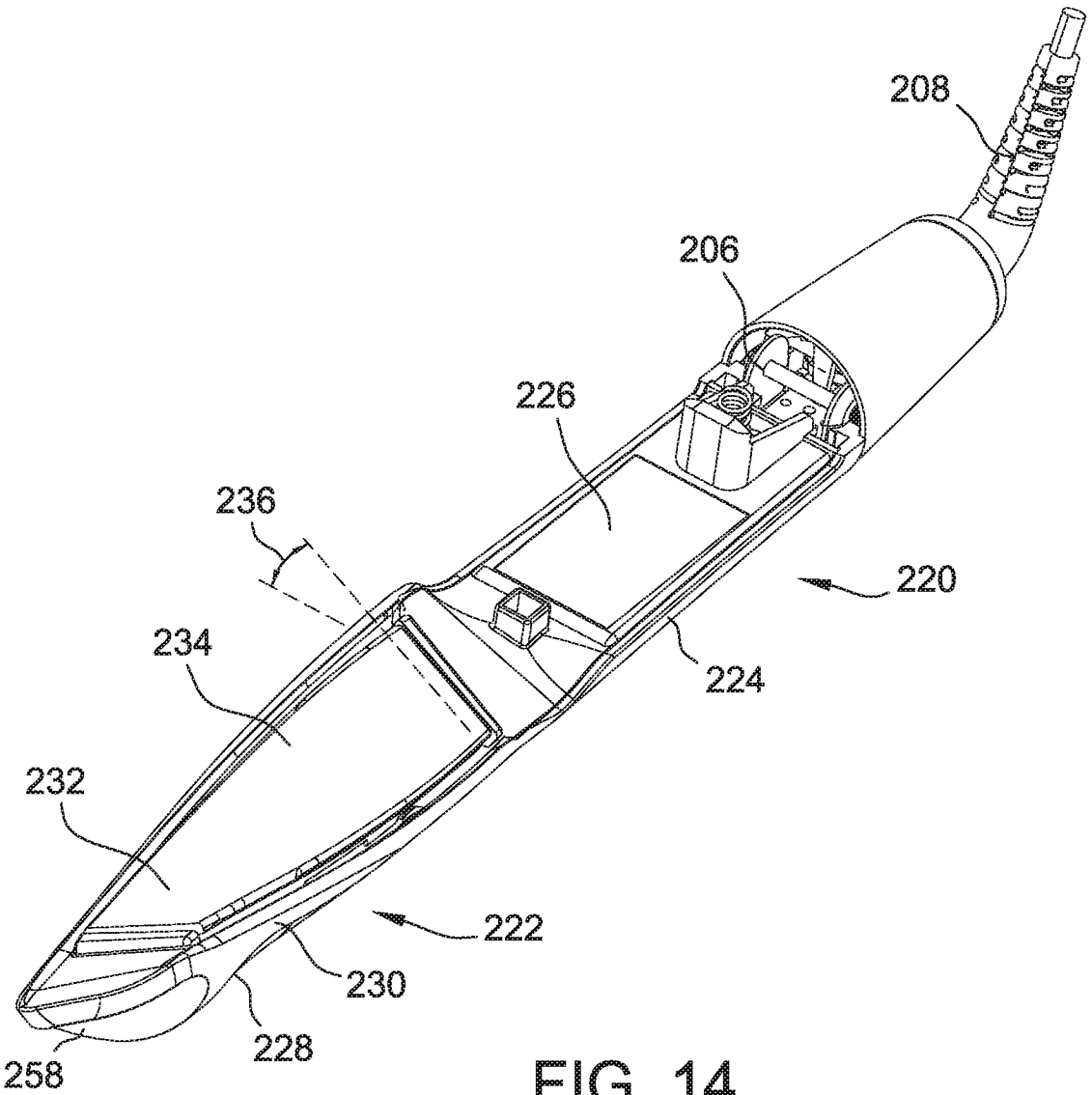
FIG. 14 is a perspective view of a portion of the hair styler of FIG. 11 with the lower arm removed to illustrate the twisted hair contact surface of the upper arm of the styler.

The upper arm 202 includes an upper grip 220 and an upper clamp head 222. The upper grip 220 includes an outer wall 224 and an inner wall 226 (FIG. 14). The upper clamp head 222 includes a top 228, two sides 230, and an upper clamp plate 232. The upper clamp plate 232 has an upper hair contact surface 234 that extends between the sides 230 of the upper clamp head 222 at a first twist angle 236 relative to the inner wall 226 of the upper grip 220.

Figure 13:
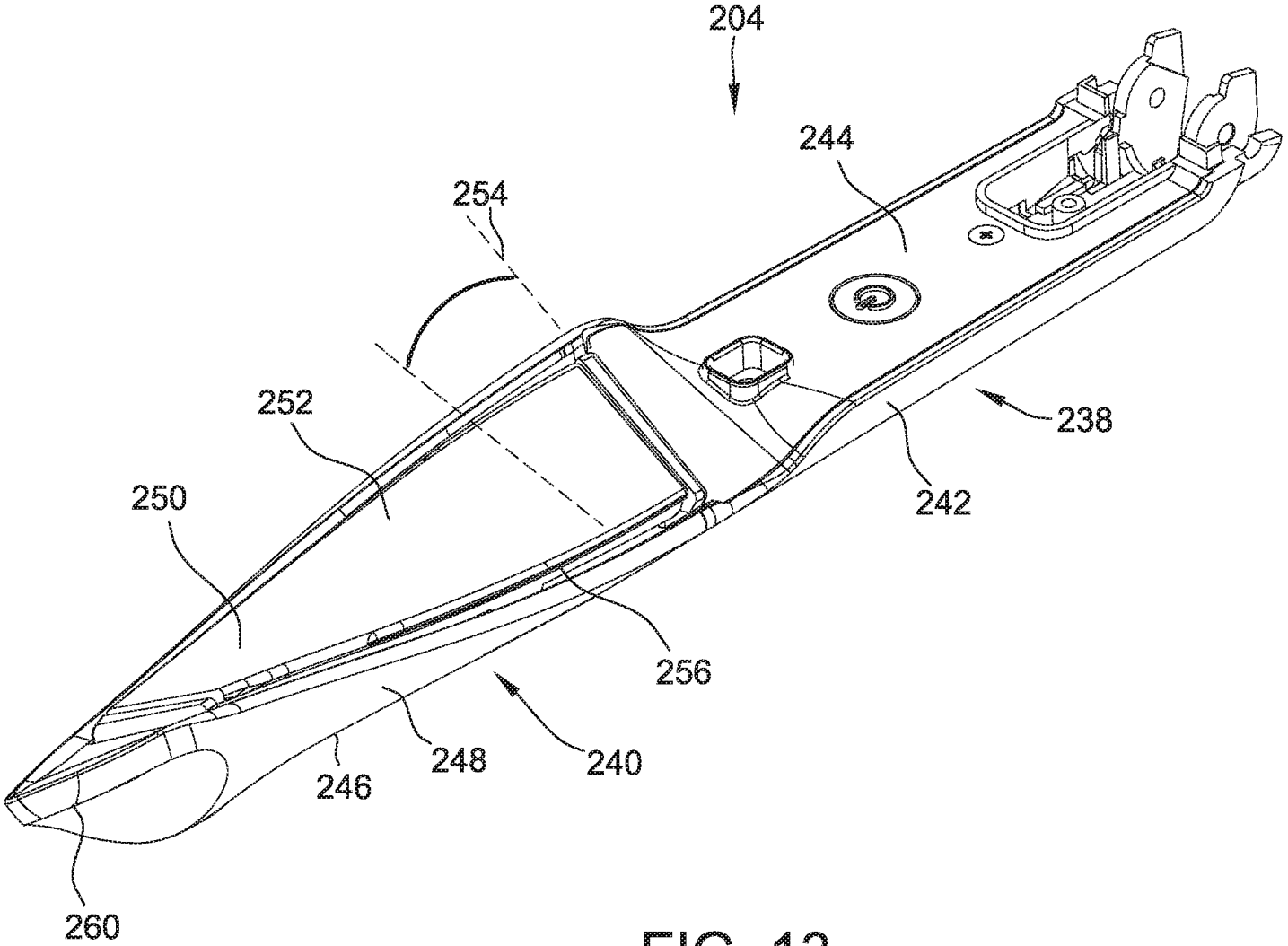
FIG. 13 is a perspective view of a portion of the hair styler of FIG. 11 with the upper arm removed to illustrate the twisted hair contact surface of the lower arm of the styler.

The lower arm 204 includes a lower grip 238 and a lower clamp head 240. The lower grip 238 includes an outer wall 242 and an inner wall 244 (FIG. 13). The lower clamp head 240 includes a bottom 246, two sides 248, and a lower clamp plate 250. The lower clamp plate 250 has a lower hair contact surface 252 that extends between the sides 248 of the lower clamp head 240 at a second twist angle 254 relative to the inner wall 244 of the lower grip 238.

Referring to FIGS. 13 and 14, edges 256 of the upper and lower hair contact surfaces 234, 252 and the sides 230, 248 of the upper and lower clamp heads 222, 240 are free of any teeth or other surface features and are substantially smooth. Moreover, the entire upper and lower hair contact surfaces 234, 252 between the sides 230, 248 are substantially smooth and free of surface features. As a result, the configuration of the upper and lower hair contact surfaces 234, 252 may reduce potential damage to delicate or fine hair during a styling operation.

The hair styler 200 includes an upper end grip 258 attached to the upper clamp head 222 and a lower end grip 260 attached to the lower clamp head 240. The upper end grip 258 and the lower end grip 260 are located opposite the upper grip 220 and the lower grip 238 on ends of the upper arm 202 and the lower arm 204. Accordingly, the user is able to grip opposite ends of the upper arm 202 and the lower arm 204 of the hair styler 200 for clamping the upper and lower clamp heads 222, 240 onto hair and guiding the styler during a hair styling operation.

Embodiments of the hair styler described herein allow a user to curl or straighten hair using a single hair styler. In addition, the twisted configuration of the styler allows the user to comfortably grasp and manipulate the styler during a range of styling operations. Moreover, the twisted hair contact surfaces may be configured to provide a more efficient styling operation than other stylers. For example, the hair contact surfaces may be configured to deliver heat to hair in desired locations as the hair contacts and is styled using the twisted hair contact surfaces.

When introducing elements of the present disclosure or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the disclosure, it is intended that all matter contained in the above description or shown in the accompanying drawings shall be interpreted as illustrative and not in a limiting sense.

What is claimed is:

1. A hair styler comprising:

an upper arm including an upper grip and an upper clamp head, the upper clamp head including an upper hair contact surface, wherein the upper hair contact surface is twisted relative to the upper grip;

a lower arm including a lower grip and a lower clamp head, the lower clamp head including a lower hair contact surface, wherein the lower hair contact surface is twisted relative to the lower grip; and a hinge attaching the upper and lower arms together such that the upper and lower arms are openable and closeable relative to one another, wherein the hair styler is configured to receive hair between the upper and lower hair contact surfaces when the hair styler is in a closed position, wherein the upper hair contact surface and the lower hair contact surface extend between sides of the upper clamp head and the lower clamp head, wherein the entirety of the upper and lower hair contact surfaces are smooth and free of any teeth, and wherein the sides of the upper clamp head and the lower clamp head include teeth along edges of the upper clamp head and the lower clamp head.

2. The hair styler of claim 1, wherein the upper hair contact surface has a first twist angle and the lower hair contact surface has a second twist angle, wherein the first twist angle is equal to the second twist angle such that the upper and lower hair contact surfaces fit together when the hair styler is in the closed position.

3. The hair styler of claim 1, wherein the upper hair contact surface has a first twist angle and the lower hair contact surface has a second twist angle, wherein the first twist angle and the second twist angle each are in a range of 60 degrees to 120 degrees.

4. The hair styler of claim 1, wherein the upper clamp head includes a top and an upper clamp plate, the upper clamp plate including the upper hair contact surface and being angled relative to the upper grip.

5. The hair styler of claim 4, wherein the lower clamp head includes a bottom and a lower clamp plate, the lower clamp plate including the lower hair contact surface and being angled relative to the lower grip.

6. The hair styler of claim 5, further comprising a first insulation layer positioned between the upper hair contact surface and the top of the upper clamp head and a second insulation layer positioned between the lower hair contact surface and the bottom of the lower clamp head.

7. The hair styler of claim 1, further comprising a heating system configured to deliver heat to hair positioned between the upper hair contact surface and the lower hair contact surface.

8. The hair styler of claim 1, wherein the teeth include first teeth along the edge of the upper hair contact surface and second teeth along the edge of the lower hair contact surface, wherein the first teeth and the second teeth are arranged to engage each other when the hair styler is in the closed position.

9. The hair styler of claim 1, further comprising an upper end grip at an end of at least one of the upper arm and the lower arm opposite the upper and lower grips.

10. A hair styler comprising:

a first arm including a first clamp plate including a first hair contact surface, wherein the first clamp plate is twisted;

a second arm including a second clamp plate including a second hair contact surface, wherein the second clamp plate is twisted;

a hinge attaching the first and second arms together such that the first and second arms are openable and closeable relative to one another, wherein the hair styler is configured to receive hair between the first and second clamp plates when the hair styler is in a closed position; and a heating system configured to deliver heat to the hair positioned between the first and second clamp plates, wherein the first hair contact surface and the second hair contact surface extend between sides of the first clamp plate and the second clamp plate, wherein the entirety of the first and second hair contact surfaces are smooth and free of any teeth, and wherein the sides of the first clamp plate and the second clamp plate include teeth along edges of the first clamp plate and the second clamp plate.

11. The hair styler of claim 10, wherein the heating system includes a first heating element extending along the first clamp plate and a second heating element extending along the second clamp plate.

12. The hair styler of claim 10, wherein the first clamp plate has a first twist angle and the second clamp plate has a second twist angle, wherein the first twist angle and the second twist angle each are in a range of 60 degrees to 120 degrees.

13. The hair styler of claim 10, wherein the first arm further includes a first grip attached to the first clamp plate, the first clamp plate being angled relative to the first grip.

14. The hair styler of claim 13, wherein the second arm includes a second grip attached to the second clamp plate, the second clamp plate being angled relative to the second grip.

15. The hair styler of claim 14, further comprising a first insulation layer positioned along the first hair contact surface and a second insulation layer positioned along the second hair contact surface.

16. A hair styler comprising:

a first clamp head including a first hair contact surface, wherein the first hair contact surface is twisted;

a second clamp head including a second hair contact surface, wherein the second hair contact surface is twisted;

a handle attached to at least one of the first clamp head and the second clamp head; and a hinge attaching the first and second clamp heads together such that the first and second clamp heads are openable and closeable relative to one another, wherein the hair styler is configured to receive hair between the first and second hair contact surfaces when the hair styler is in a closed position, wherein the first hair contact surface and the second hair contact surface extend between sides of the first clamp head and the second clamp head, wherein the entirety of the first and second hair contact surfaces are smooth and free of any teeth, and wherein the sides of the first clamp head and the second clamp head include teeth along edges of the first clamp head and the second clamp head.

17. The hair styler of claim 16, wherein the handle includes a first grip attached to the first clamp head and a second grip attached to the second clamp head.

18. The hair styler of claim 17, wherein the first grip and the second grip each include an inner plate, wherein the inner plates are planar, the first and second hair contact surfaces being twisted relative to the inner plates.

19. The hair styler of claim 16, wherein the first hair contact surface has a first twist angle and the second hair contact surface has a second twist angle, wherein the first twist angle and the second twist angle each are in a range of 60 degrees to 120 degrees.

* * * * *